US011598333B2

(12) United States Patent
Lissel et al.

(10) Patent No.: US 11,598,333 B2
(45) Date of Patent: Mar. 7, 2023

(54) CLEARANCE ADJUSTMENT FOR TWIN-SCREW PUMPS

(71) Applicant: ITT Bornemann GmbH, Obernkirchen (DE)

(72) Inventors: Manuela Lissel, Stadthagen (DE); Eike Steffen Korte, Petershagen (DE); David Johannes Blatt, Meerbeck (DE)

(73) Assignee: ITT Bornemann GmbH, Obernkirchen (DE)

( * ) Notice: Subject to any disclaimer, the term of this patent is extended or adjusted under 35 U.S.C. 154(b) by 0 days.

(21) Appl. No.: 17/410,656

(22) Filed: Aug. 24, 2021

(65) Prior Publication Data

US 2022/0090598 A1 Mar. 24, 2022

(30) Foreign Application Priority Data

Sep. 18, 2020 (DE) ..... 10 2020 124 392.8

(51) Int. Cl.

| | |
|---|---|
| ***F01C 1/16*** | (2006.01) |
| ***F03C 2/00*** | (2006.01) |
| ***F03C 4/00*** | (2006.01) |
| ***F04C 18/00*** | (2006.01) |
| ***F04C 2/16*** | (2006.01) |
| ***F04C 15/00*** | (2006.01) |

(52) U.S. Cl.

CPC ..... *F04C 2/16* (2013.01); *F04C 15/0061* (2013.01); *F04C 2230/601* (2013.01); *F04C 2230/602* (2013.01); *F04C 2240/30* (2013.01); *F04C 2240/60* (2013.01); *F04C 2240/805* (2013.01)

(58) Field of Classification Search

CPC .... F04C 2/16; F04C 15/0057; F04C 15/0061; F04C 15/0073; F04C 15/0076; F04C 29/0071; F04C 29/0078; F04C 2230/60; F04C 2230/601; F04C 2230/602; F04C 2230/70; F04C 2240/30; F04C 2240/50; F04C 2240/56; F04C 2240/60; F04C 2240/605; F04C 2240/805; B25B 29/02; B23P 19/067

See application file for complete search history.

(56) References Cited

U.S. PATENT DOCUMENTS 847,581 A * 3/1907 Jenson ..... B25B 13/16 81/174
2,923,191 A * 2/1960 Fulop ..... B25B 21/023 81/474
4,453,901 A * 6/1984 Zimmerly ..... F04C 15/0076 418/206.1

(Continued)

*Primary Examiner* — Theresa Trieu
(74) *Attorney, Agent, or Firm* — Mannava & Kang, P.C.

(57) ABSTRACT

Technologies are generally described for clearance adjustments in twin-screw pump assemblies. A twin-screw pump assembly may include a conically shaped portion of a drive shaft enveloped by a bushing. For clearance adjustment, both clamping nuts of the drive shaft, which provide pretention to the bushing and secure an axial position of a threaded screw to the drive shaft, may be removed on the flow side of the pump assembly and the bushing loosened to adjust the angularity between bushing and drive shaft. The bushing may then be pushed over the conically shaped portion and both clamping nuts re-assembled. In some examples, a clamping nut of the driven shaft may be designed and used as removal/loosening tool for the drive shaft bushing.

19 Claims, 8 Drawing Sheets

(56) References Cited

U.S. PATENT DOCUMENTS

| | | | | |
|---|---|---|---|---|
| 6,027,322 | A * | 2/2000 | Ferentinos | F04C 18/16 418/1 |
| 6,129,533 | A * | 10/2000 | Brandt | F04C 15/0038 418/104 |
| 2007/0196228 | A1* | 8/2007 | Tunna | F04C 29/0092 418/201.1 |
| 2013/0251581 | A1* | 9/2013 | Christov | F04C 2/16 418/201.1 |
| 2014/0348686 | A1* | 11/2014 | Paval | F04C 2/16 418/201.1 |

* cited by examiner

CLEARANCE ADJUSTMENT FOR TWIN-SCREW PUMPS

CROSS-REFERENCE TO RELATED APPLICATIONS

This application claims priority to German Patent Application No. 10 2020 124 392.8 filed on Sep. 18, 2020, by the same inventors and same Applicant. The disclosures of the priority application are incorporated by reference in their entirety hereby.

BACKGROUND

Unless otherwise indicated herein, the materials described in this section are not prior art to the claims in this application and are not admitted as prior art by inclusion in this section.

Screw pumps are rotating positive displacement pumps, using two screws to convey fluids along the screw axis. The intermeshing screws and the housing form closed chambers, constantly moving fluids from suction to discharge. By one turn of the drive shaft, the flow direction goes from the front axial to the mid top position. The pump can operate in the opposite direction as well, for example, to empty the suction piping from remaining fluid before cleaning. Screw pumps may be used in food and beverage industries (hygienic applications), as well as, chemical, petrochemical, and marine applications.

SUMMARY

The present disclosure generally describes clearance adjustments for twin-screw pumps and methods associated therewith.

According to some examples, a method for clearance adjustment of a pump assembly may include removing a first clamping nut (clamping nut 315) that secures rotatably an axial position of a first threaded screw to a drive shaft of the pump assembly, where the drive shaft is configured to receive a rotational force outside the pump assembly, the drive shaft comprises a first portion inside a gear chamber defined by the housing and a second portion inside a flow chamber defined by the housing, and at least part of the second portion of the drive shaft is conically shaped. The method may also include removing a second clamping nut (clamping nut 313) that provides pretension to a bushing (bushing 322) that envelopes the conically shaped part of the second portion of the drive shaft; loosening the bushing; and adjusting an angularity between the bushing and the drive shaft to enhance clearances between a first plurality of thread flanks of the first threaded screw and a second plurality of thread flanks of a second threaded screw coupled to a driven shaft, where the driven shaft comprises a first portion inside the gear chamber and a second portion inside the flow chamber, the first portion of the driven shaft is mechanically coupled to the first portion of the drive shaft through one or more timing gears and configured to receive a rotational force from the drive shaft, and the second portion of the driven shaft is coupled to the second plurality of thread flanks of the second threaded screw intermeshed with the first plurality of thread flanks of the first threaded screw.

According to other examples, the method may further include re-assembling the second clamping nut to secure rotatably the bushing and the drive shaft with the adjusted angularity; prior to removing the first and second clamping nuts, removing a third clamping nut (clamping nut 312) that secures rotatably an axial position of the second threaded screw to the driven shaft; loosening the bushing using the third clamping nut; and/or subsequent to re-assembling the second clamping nut, re-assembling the first clamping nut and the third clamping nut.

According to further examples, a pump assembly may include a housing that includes a first housing wall portion that defines an inlet port, an outlet port, and a flow chamber formed therein, where the flow chamber is configured to receive a fluid through the inlet port; and a second housing wall portion that defines a gear chamber formed therein, where the flow chamber and the gear chamber are fluidically isolated. The pump assembly may also include a drive shaft configured to receive a rotational force outside the pump assembly, the drive shaft including a first portion inside the gear chamber and a second portion inside the flow chamber, where at least part of the second portion of the drive shaft is conically shaped; a first threaded screw including a first plurality of thread flanks and coupled to the second portion of the drive shaft; a first clamping nut configured to secure rotatably an axial position of the first threaded screw to the drive shaft; a bushing configured to envelope the conically shaped part of the second portion of the drive shaft; and a second clamping nut configured to provide pretension to the bushing, where a clearance adjustment is performed by removal of the first and second clamping nuts, loosening of the bushing, and adjustment of an angularity between the bushing and the drive shaft. The pump assembly may further include a driven shaft including a first portion inside the gear chamber and a second portion inside the flow chamber, where the first portion of the driven shaft is configured to receive a rotational force inside the gear chamber from the drive shaft, and the second portion of the driven shaft is coupled to a second threaded screw including a second plurality of thread flanks intermeshed with the first plurality of thread flanks of the second portion of the drive shaft.

According to yet other examples, the pump assembly may include a third clamping nut to secure rotatably an axial position of the second threaded screw to the driven shaft. The drive shaft and the first plurality of thread flanks may be integrated, and the driven shaft and the second plurality of thread flanks may be integrated. The conically shaped part of the second portion of the drive shaft may have an inclination angle in a range from about 1 degree to about 10 degrees. The flow chamber and the gear chamber may be fluidically isolated. The first housing wall may define at least one additional inlet port and/or at least one additional outlet port. The pump assembly may be a dual flow pump assembly. The bushing may be made from one or more of a metal, a metal alloy, a ceramic, or a plastic.

According to some examples, a pump assembly may include a housing that includes a first housing wall portion that defines an inlet port, an outlet port, and a flow chamber formed therein, where the flow chamber is configured to receive a fluid through the inlet port; and a second housing wall portion that defines a gear chamber formed therein, where the flow chamber and the gear chamber are fluidically isolated. The pump assembly may also include a drive shaft configured to receive a rotational force outside the pump assembly, the drive shaft including a first portion inside the gear chamber and a second portion inside the flow chamber; a first threaded screw including a first plurality of thread flanks and coupled to the second portion of the drive shaft; and a driven shaft including a first portion inside the gear chamber and a second portion inside the flow chamber, where the first portion of the driven shaft is configured to receive a rotational force inside the gear chamber from the drive shaft, the second portion of the driven shaft is coupled to a second threaded screw including a second plurality of thread flanks intermeshed with the first plurality of thread flanks of the second portion of the drive shaft, and at least part of the second portion of the driven shaft is conically shaped. The pump assembly may further include a first clamping nut configured to secure rotatably an axial position of the second threaded screw to the driven shaft; a bushing configured to envelope the conically shaped part of the second portion of the driven shaft; and a second clamping nut configured to provide pretension to the bushing, where a clearance adjustment is performed by removal of the first and second clamping nuts, loosening of the bushing, and adjustment of an angularity between the bushing and the driven shaft.

According to other examples, the pump assembly may further include a third clamping nut to secure rotatably an axial position of the first threaded screw to the drive shaft, where an inside surface of the third clamping nut is configured to fit over a top portion of the bushing such that the third clamping nut is usable to remove or loosen the bushing.

According to further examples, a method for manufacturing a twin-screw pump assembly may include forming a flow chamber, an inlet port, and an outlet port within a first housing wall portion of a housing to convey a fluid received through the inlet port to the outlet port; forming a gear chamber within a second housing wall portion of the housing to house one or more timing gears, a first portion of a drive shaft, and a first portion of a driven shaft, where the flow chamber and the gear chamber are fluidically isolated; positioning a drive shaft configured to receive a rotational force outside the pump assembly such that the first portion of the drive shaft is inside the gear chamber and a second portion of the drive shaft is inside the flow chamber; and positioning a driven shaft, where a first portion of the driven shaft is inside the gear chamber and a second portion of the driven shaft is inside the flow chamber, the driven shaft is configured to receive a rotational force from the drive shaft inside the gear chamber, and at least part of the second portion of one of the drive shaft and the driven shaft is conically shaped. The method may also include positioning a bushing to envelope the conically shaped part of the second portion of one of the drive shaft and the driven shaft; providing pretension to the bushing through a first clamping nut; and securing an axial position of a first threaded screw to the drive shaft or an axial position of a second threaded screw to the driven shaft rotatably with a second clamping nut, where a clearance adjustment is performed by removal of the first and second clamping nuts, loosening of the bushing, and adjustment of an angularity between the bushing and one of the drive shaft and the driven shaft.

According to further examples, the method may also include mechanically coupling the first threaded screw comprising a first plurality of thread flanks to the drive shaft inside the flow chamber; and mechanically coupling the second threaded screw comprising a second plurality of thread flanks to the driven shaft inside the flow chamber, where the first plurality of thread flanks are intermeshed with the second plurality of thread flanks. The method may further include mechanically coupling the first portion of the driven shaft to the first portion of the drive shaft through one or more timing gears in the gear chamber; forming the first plurality and the second plurality of thread flanks substantially perpendicularly to an axial direction of the drive shaft and the driven shaft; and/or forming the first plurality and the second plurality of thread flanks at an angle other than perpendicular to an axial direction of the drive shaft and the driven shaft.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1:
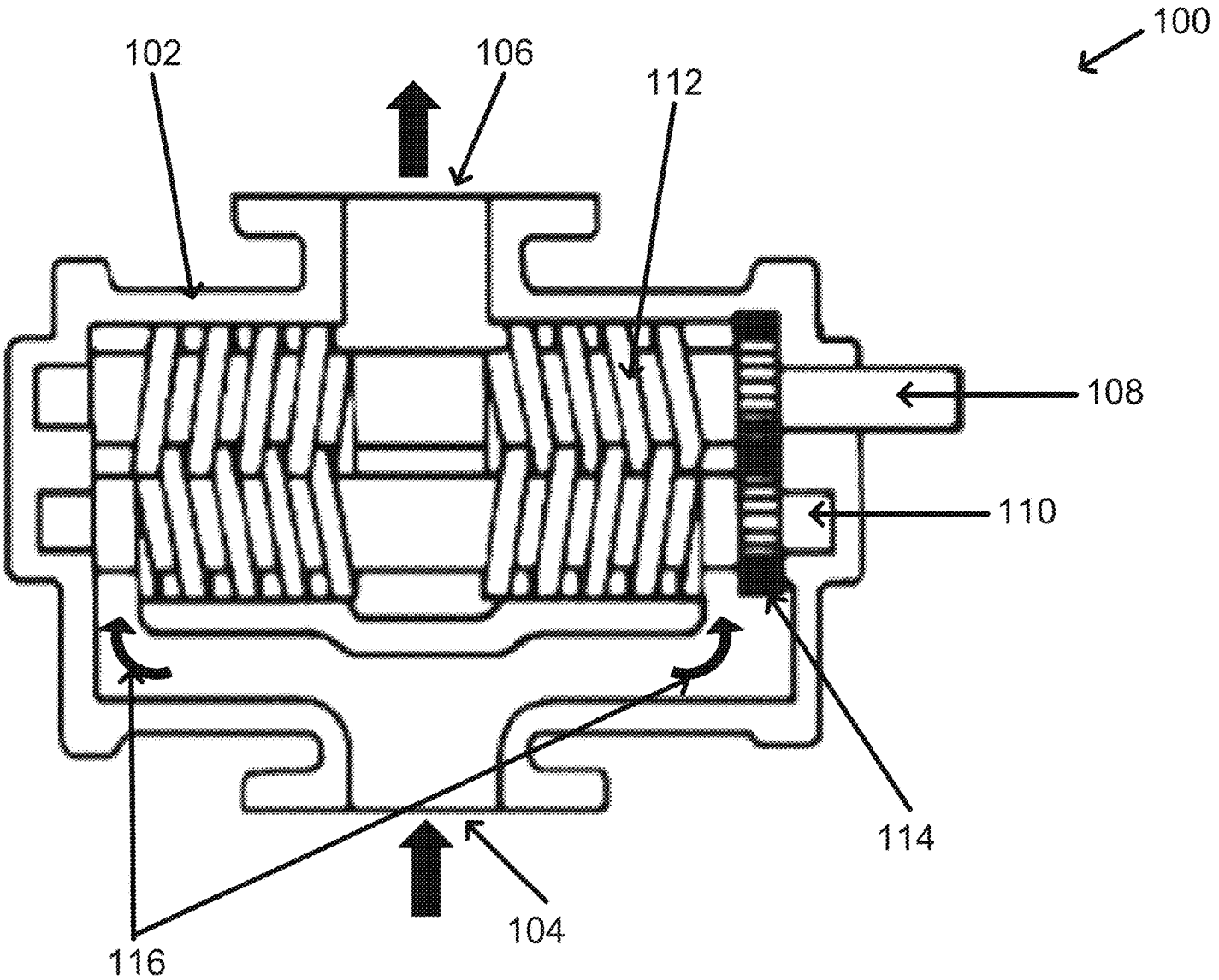
FIG. 1 illustrates a cross-sectional overview of a twin-screw pump.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. The aspects of the present disclosure, as generally described herein, and illustrated in the Figures, can be arranged, substituted, combined, separated, and designed in a wide variety of different configurations, all of which are explicitly contemplated herein.

This disclosure is generally drawn, inter alia, to methods, apparatus, systems and/or devices associated with clearance adjustments for twin-screw pumps.

Briefly stated, technologies are generally described for clearance adjustments in twin-screw pump assemblies. A twin-screw pump assembly may include a conically shaped portion of a drive shaft enveloped by a bushing. For clearance adjustment, both clamping nuts of the drive shaft, which provide pretention to the bushing and secure an axial position of a threaded screw to the drive shaft, may be removed on the flow side of the pump assembly and the bushing loosened to adjust the angularity between bushing and drive shaft. The bushing may then be pushed over the conically shaped portion and both clamping nuts re-assembled. In some examples, a clamping nut of the driven shaft may be designed and used as removal/loosening tool for the drive shaft bushing.

While example twin-screw pumps are described with a bushing over a conically shaped portion of the drive shaft and clearance adjustment being made on the drive shaft, embodiments are not limited to the example configurations. For example, the driven shaft of the pump assembly may include a conically shaped portion with a bushing fitted thereon, and clearance adjustment may be performed on the driven shaft.

FIG. 1 illustrates a cross-sectional overview of a twin-screw pump.

Diagram 100 shows an example twin-screw pump assembly with housing (or casing) 102, which contains two shafts with threads, a drive shaft 108 (also referred to as power input shaft) and a driven shaft 110. Counter-rotating threads 112 of the shafts 108 and 110 move the fluid (116) between an inlet port 104 and an outlet port 106 of the housing 102. Timing gear 114 allow synchronous operation of the shafts 108, 110.

Screw pumps are displacement pumps in which two, three, or more rotationally driven screws (shafts with threads) are driven synchronously with respect to one another and convey a medium, in particular a fluid, within a volume enclosed by a pump housing from an inlet port to an outlet port of the pump housing. A number of screw threads, a thread pitch of the external screw thread, the mounting, the number of flows, and the torque transmission are some of the parameters defining different types of screw pumps and their performance. The shafts 108, 110 are coupled to one another by means of a synchronous transmission (timing gear 114). The pump is driven from the outside via a motor which drives one of the shafts (drive shaft 108).

In a twin-screw pump, the fluid is conveyed by the counter-rotating threads with a left-hand and a right-hand screw thread. The thread flanks of one shaft run in radial grooves between the thread flanks of the other shaft and vice versa. The fluid is conveyed in the axial direction in conveying chambers formed between the thread flanks of the screw thread.

Figure 2:
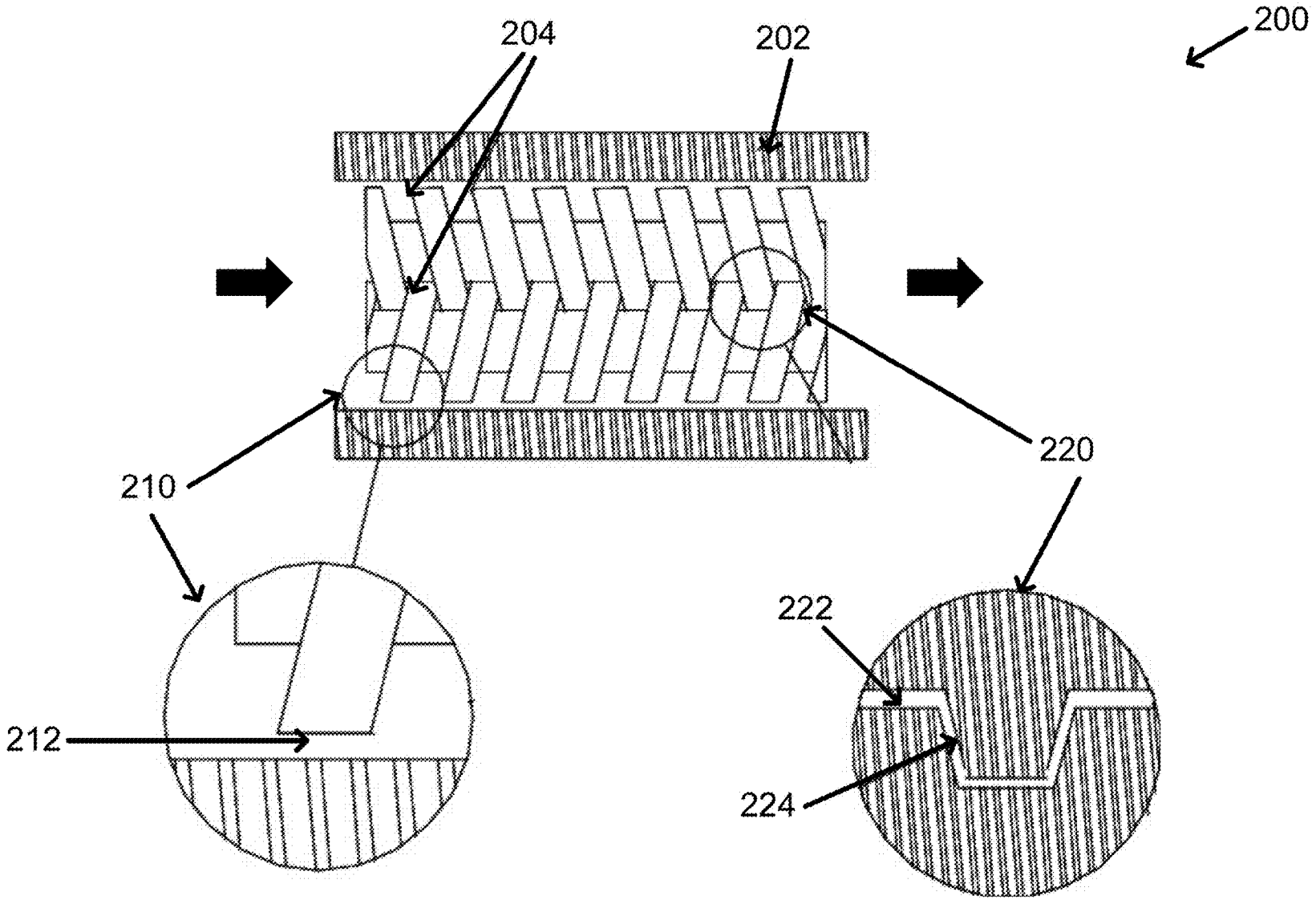
FIG. 2 illustrates example cross-sectional and perspective cutaway views of the clearance-related challenges in a twin-screw pump assembly.

FIG. 2 illustrates example cross-sectional and perspective cutaway views of the clearance-related challenges in a twin-screw pump assembly.

Diagram 200 shows a cross-section of pump housing 202 with the threaded shafts 204, where the counter-rotating thread flanks form chambers to move the fluid. An exploded view 210 of the section, where the thread flanks encounter in inside surface of the housing, show peripheral clearance 212. An exploded view 220 of the section, where the thread flanks of the shafts intermesh, show radial clearance 222 and flank clearance 224.

One of the common applications for twin-screw pumps is hygienic environments, for example, beverage, cosmetic, and other consumable fluid transmission systems. Thus, ensuring a clean inside environment for pumps in such applications is a requirement and a challenge. Although various components of the pumps such as the shafts, threads, etc. may be designed with accurate clearances, manufacturing tolerances, forces applied to the components during operation, changes in fluid composition (particles in the fluids, fluid viscosity, etc.) may cause thread flanks and/or housing walls to contact and metal shavings or similar contaminants to enter the transported fluids. Diagram 200 shows three possible sources for contact-caused contamination (e.g., metal shavings) among others.

For the above-discussed reasons, clearance adjustment for twin-screw pumps at installation and at various points during operation is common practice. Example clearance adjustment procedures typically involve removal of multiple components, drainage of lubricants, etc. Clearance adjustment is typically performed on the gear side of the pump assembly (see FIG. 3B) and may require special equipment, personnel with training, and result in appreciable down time for the pump assembly.

Figure 3A:
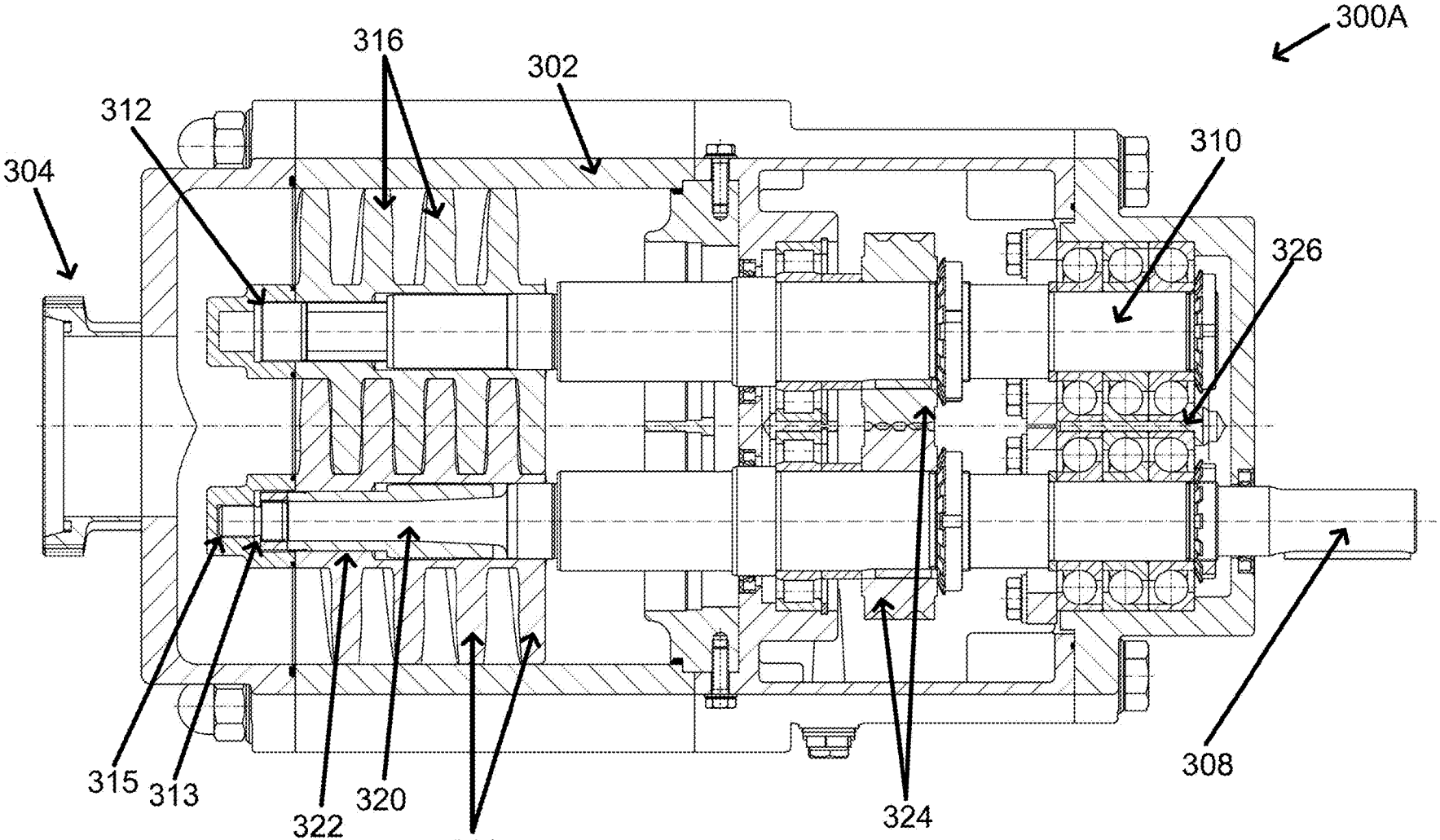
FIG. 3A illustrates a cross-sectional view of a twin-screw pump assembly with a bushing on the drive shaft and clamping nuts on both shafts in accordance with at least some embodiments as described herein.

FIG. 3A illustrates a cross-sectional view of a twin-screw pump assembly with a bushing on the drive shaft and clamping nuts on both shafts in accordance with at least some embodiments as described herein.

Diagram 300A of an example twin-screw pump assembly according to embodiments includes pump housing 302, inlet port 304 (outlet port not shown in this diagram), drive shaft 308, driven shaft 310, driven shaft thread flanks 316, drive shaft thread flanks 318, a conically shaped portion 320 of the drive shaft, timing gears 324, and anti-friction bearings 326 for thrust and radial loads. The assembly further includes a bushing 322 covering a substantial portion of the conically shaped portion 320 of the drive shaft. Clamping nut 312 secures the axial position of the driven shaft threads 316 on the flow side of the pump assembly, where the fluid is transported from the inlet port to the outlet port. Clamping nut 315 secures axial position of the drive shaft threads 318. Clamping nut 313 provides pretension to the bushing 322.

The timing gears 324 provide synchronous rotation of the shafts. In addition to the timing gears 324 and anti-friction bearings 326, the gear side chamber of the pump assembly may include a number of bearings such as axial bearings. The axial bearings may be designed as roller bearings, in particular as axial bearings acting on both sides. Roller bearings are bearings in which two components that can be moved relatively to each other are separated from each other by rolling bodies. The rolling bodies are arranged in a cage which holds the rolling bodies at a defined distance from each other. Balls and various roller types, such as cylinder rollers, tapered rollers, needle rollers, and barrel rollers may be used as rolling bodies. Roller bearings provide very low friction and thereby lower wear of the components.

The thread flanks 316 and 318 intermesh between the two shafts and through their counter-rotation enable flow of the fluid from the inlet port 304 to the outlet port. In a pump assembly according to embodiments, clearance adjustment may be performed on the flow side and clamping nuts 313, 315 may be removed along with cover (with inlet port 304) and housing 302. The bushing 322 enveloping the conically shaped portion 320 of the drive shaft may be loosened and clearance adjustment made before reassembly.

The twin-screw pump is commonly single flow, that is, the fluid is conveyed axially in one direction. However, twin-screw pumps may also be implemented as dual-flow pumps. The housing of the twin-screw pump may have one inlet port and one outlet port as shown in the figures. However, pump assemblies may also be configured with multiple inlet ports and/or outlet ports. The inlet and/or outlet ports may be oriented axially or orthogonally to the longitudinal extent of the shafts. The axial and/or radial bearings may be designed to be independent of the conveying direction and/or independent of the direction of rotation. The diagonally opposite axial bearings and/or opposite radial bearings may be identical so that the same bearings, which must only be turned once to be used on the other side, are provided on both sides of the screw threads. In some examples, the bearing arrangement may have a point symmetry. In a twin-screw pump, the symmetry point may be a point in the center between the screw threads.

Figure 3B:
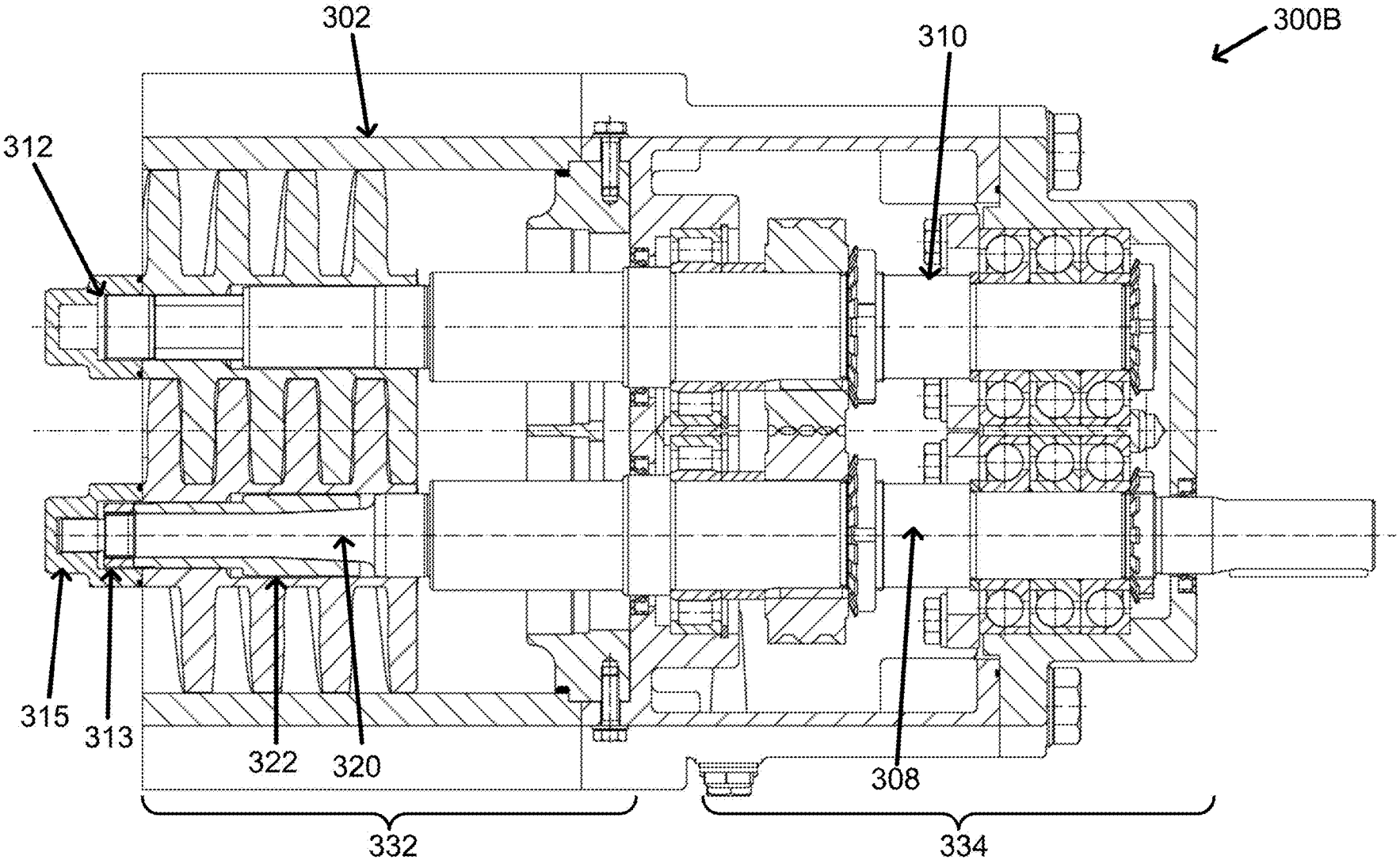
FIG. 3B illustrates another cross-sectional view of a twin-screw pump assembly with a bushing on the drive shaft and clamping nuts on both shafts in accordance with at least some embodiments as described herein.

FIG. 3B illustrates another cross-sectional view of a twin-screw pump assembly with a bushing on the drive shaft and clamping nuts on both shafts in accordance with at least some embodiments as described herein.

As shown in the simplified pump assembly cross-section in diagram 300B, the clearance adjustment process according to some embodiments includes removal of clamping nuts 313, 315 and loosening of bushing 322 to adjust the angularity between bushing 322 and drive shaft 308. The adjustment is performed on the flow side 332 as opposed to conventional adjustment methods performed on the gear side 334 and does not involve removal of multiple components or drainage of lubricant.

In a twin-screw pump assembly, the gear side 334 includes a chamber that houses the timing gears, as well as, bearings and is typically filled with lubricant. The flow side 332, on the other hand, contains the thread flanks of the drive and driven shafts and is filled with the transported fluid. Therefore, the two sides are sealed from each other. The housing on the flow side may define two distinct chambers, a suction-side (or collection) chamber and a pressure-side (or thrust) chamber, where the inlet port provides the fluid into the collection chamber. The fluid is transported to the thrust chamber by the counter-rotating thread flanks and provided to the outlet port.

The bushing 322 may have a conically shaped inside surface to match the outside surface of the conically shaped portion 320 of the drive shaft 308. The outer surface of the bushing 322 and an inside surface of the threaded screw may be designed for transmission of torque (form fit). Torque is transmitted from the shaft 308 to the bushing 322 by friction (pretension of cone bushing). Thus, the torque is transmitted from the shaft to the bushing and from the bushing to the threaded screw. The conical shape may allow for easy loosening of the bushing from the drive shaft body and allow clearance adjustment. In some example embodiments, the clamping nut 312 may be designed such that an inside surface of the clamping nut 312 fits over a top portion of the outside surface of the bushing 322. Thus, the clamping nut 312 may be used as a tool to remove the bushing 322, thereby eliminating a need to have a special tool on site for the clearance adjustment. Clamping nuts 312 and 315 may have similar outside surfaces (size) to allow for removal by the same tool. Dimensions of the conically shaped portion 320 of the drive shaft may be scalable based on overall dimensions of the pump assembly (and thereby the drive shaft). In some examples, an inclination angle of the conically shaped portion 320 may range between about 1 degree and about 10 degrees.

In an operational configuration, the bushing 322 envelopes the conically shaped portion 320 of the drive shaft 308 and the clamping nut 313 provides pretension to the bushing 322 while clamping nut 315 secures the axial position of threaded screw of the drive shaft 308 in a rotatable fashion. For clearance adjustment, the clamping nuts 313, 315 may be removed, followed by loosening of the bushing 322 around the conically shaped portion 320 of the drive shaft 308. The angularity between bushing and drive shaft may then be adjusted for clearance and the bushing pushed back, followed by the re-assembly of the clamping nuts 313, 315. Thus, no other components beside the clamping nuts, the cover, and housing need to be removed or any lubricant drained substantially reducing down time for the pump assembly during the adjustment.

Various components of an example pump assembly mentioned herein may be formed from a variety of suitable materials such as metal, alloy, ceramic, plastic, and others as needed. While example embodiments are described in twin-screw configuration, other similar pump assemblies (e.g., multiple-screw pumps) may also be formed and adjusted for clearance using the principles described herein.

Figure 4:
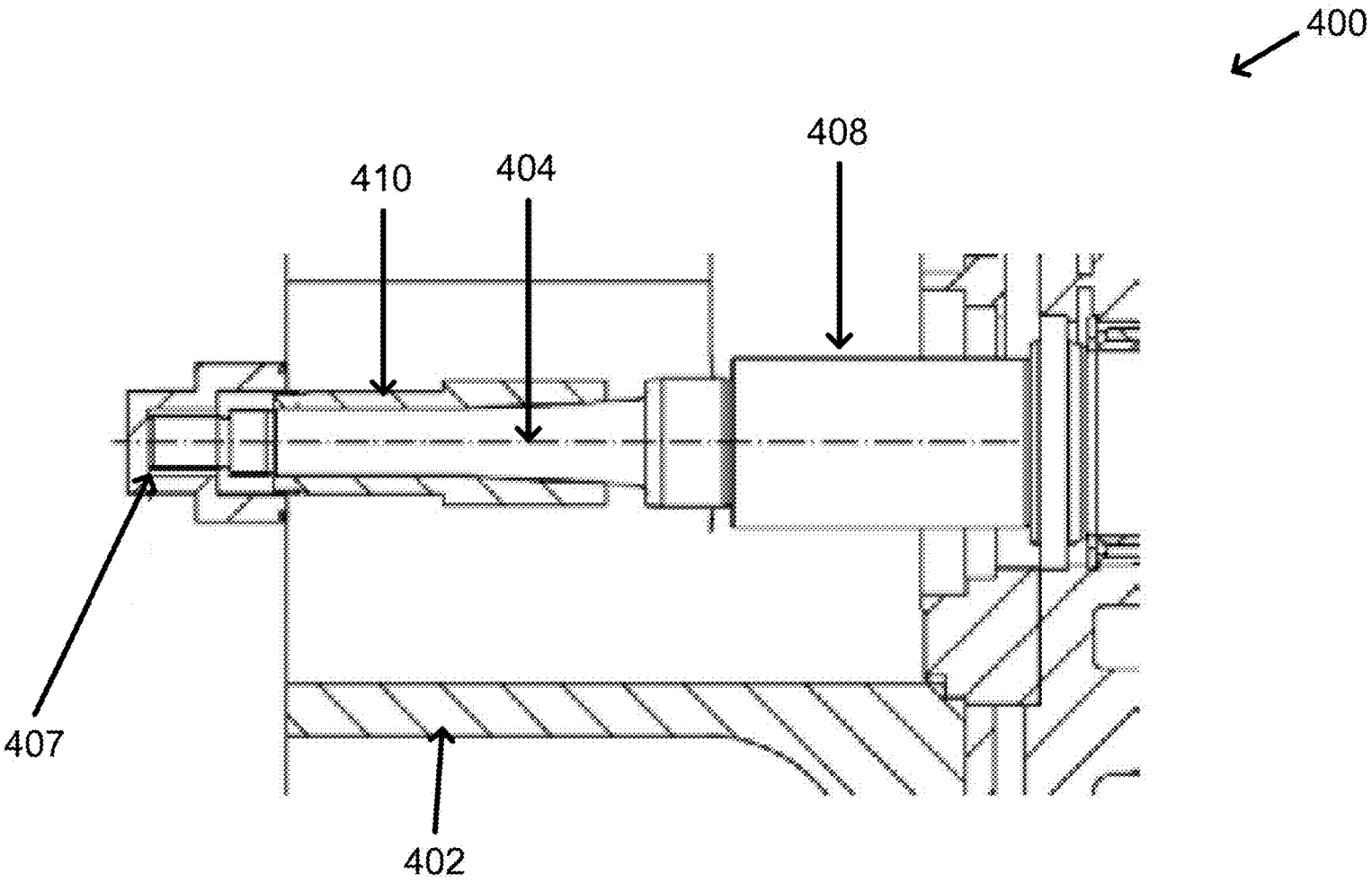
FIG. 4 illustrates disassembly/loosening of a bushing on a drive shaft with clamping nut of a driven shaft in a cross-sectional close-up view of a portion of the twin-screw pump assembly, where clearance adjustment may be performed in accordance with at least some embodiments as described herein.

FIG. 4 illustrates disassembly/loosening of a bushing on a drive shaft with clamping nut of a driven shaft in a cross-sectional close-up view of a portion of the twin-screw pump assembly, where clearance adjustment may be performed in accordance with at least some embodiments as described herein.

Diagram 400 includes a portion of pump assembly housing 402, drive shaft 408 with a conically shaped portion 404, bushing 410 configured to envelope the conically shaped portion 404 of the drive shaft 408, and clamping nut 407.

Clamping nut 407 is used to secure the axial position of the threaded screw of the driven shaft (not shown in this figure) and is used for loosening the bushing 410 upon being removed from the driven shaft. Bushing 410 is pulled with clamping nut 407 while axial position of clamping nut 407 is fixed by drive shaft 408. The loosening process may be performed with or without a threaded screw on bushing.

As mentioned previously, the driven shaft of the pump assembly may also include a conically shaped portion with a bushing fitted thereon, and clearance adjustment may be performed on the driven shaft, for example, by removing the clamping nut of the drive shaft and using it to loosen the bushing on the driven shaft.

Figure 5:
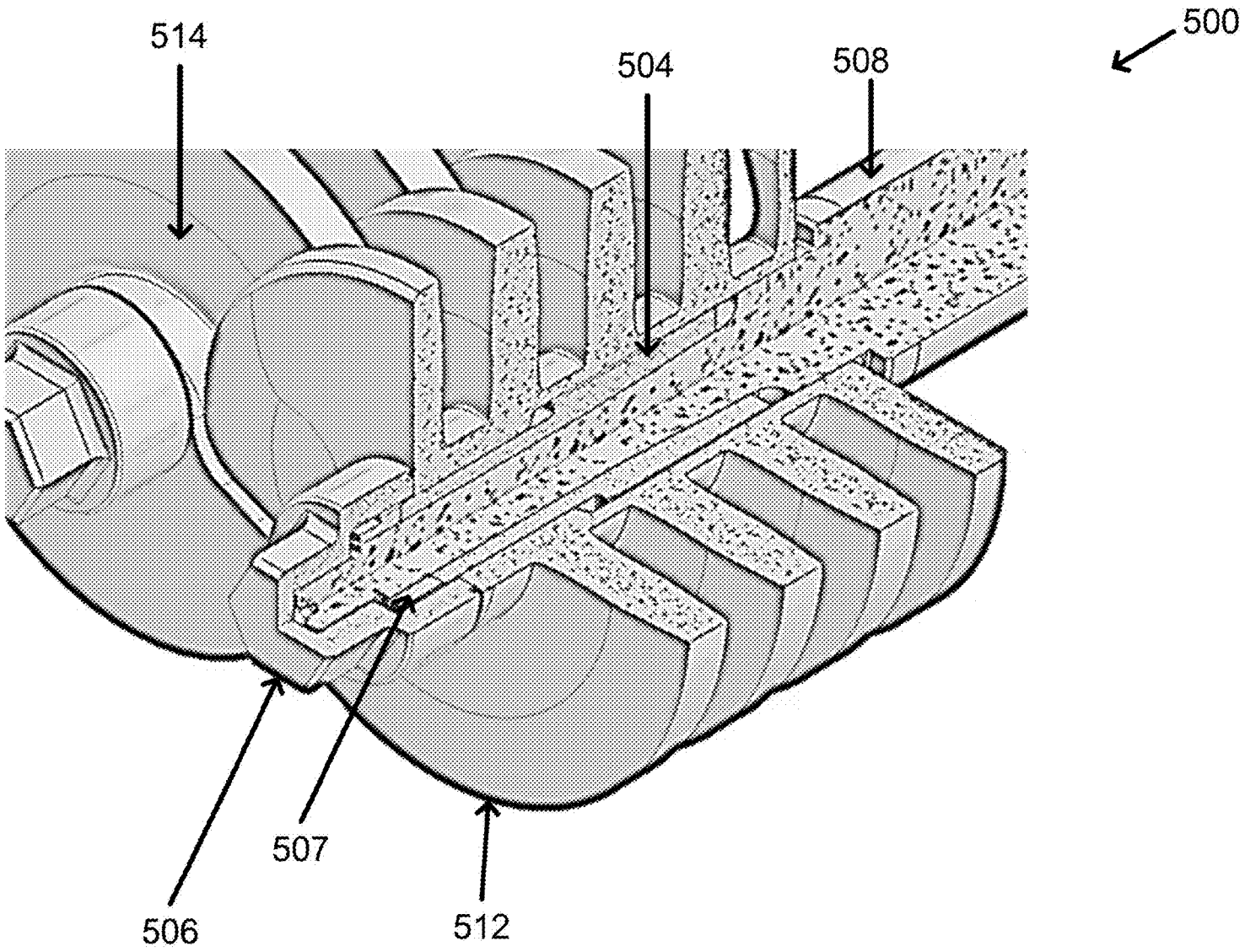
FIG. 5 illustrates a cutout close-up view of a portion of the drive shaft of a twin-screw pump assembly with the threaded screw, where clearance adjustment may be performed in accordance with at least some embodiments as described herein.

FIG. 5 illustrates a cutout close-up view of a portion of the drive shaft of a twin-screw pump assembly with the threaded screw, where clearance adjustment may be performed in accordance with at least some embodiments as described herein.

The cutout close-up view in FIG. 5 shows drive shaft 508, threaded screw 512, bushing 504, threaded screw 514 of the driven shaft, and clamping nuts 506, 507. The diagram 500 shows the form fit between the bushing 504 and the threaded screw 512 for transmission of torque. Between the shaft and the bushing, torque is transmitted by friction (pretension of cone bushing). As discussed previously, clamping nut 507 provides pretension to the bushing 504 and the clamping nut 506 secures the axial position of the threaded screw 512. The diagram also shows the intermeshing of the thread flanks of both threaded screws.

Figure 6:
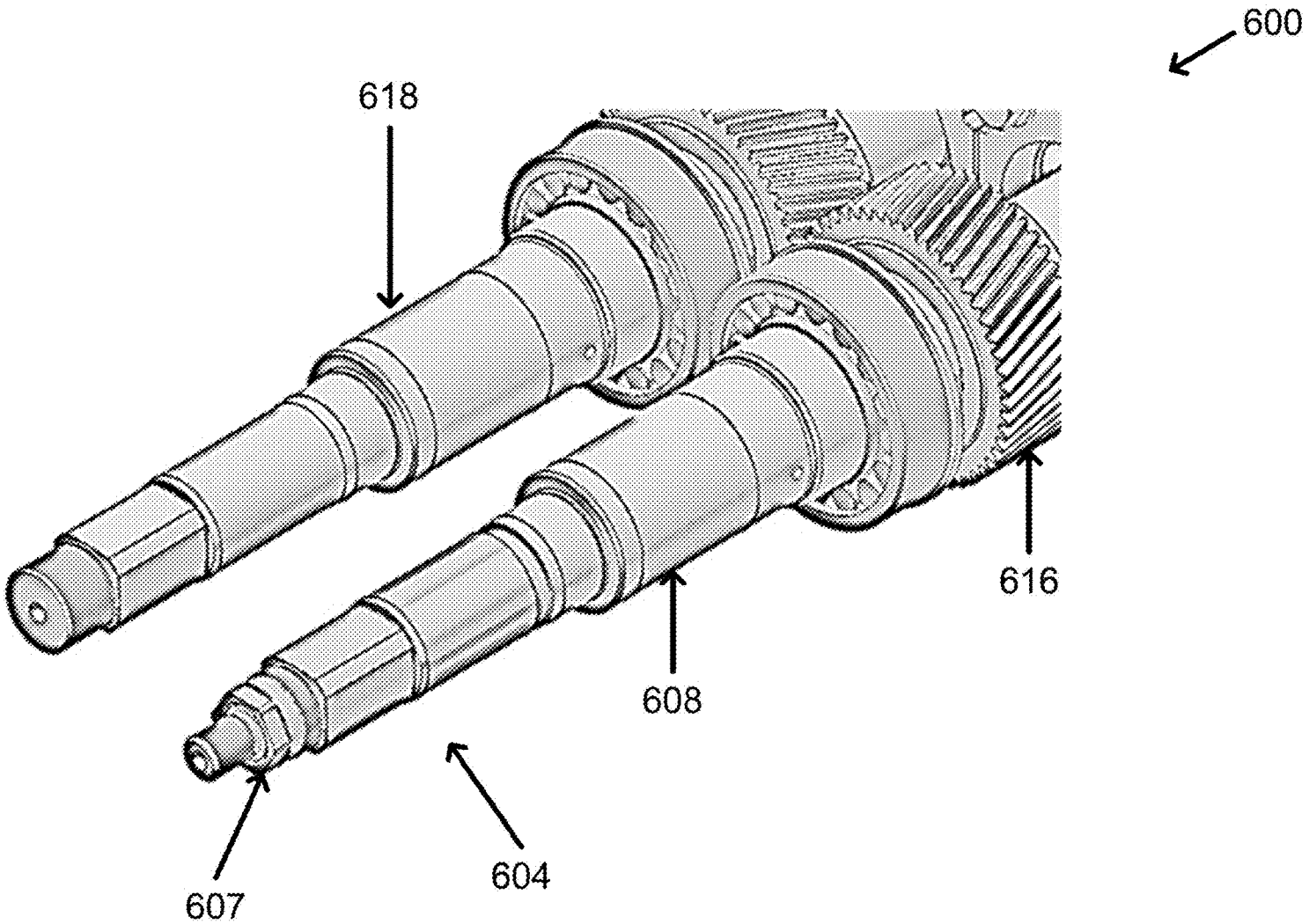
FIG. 6 illustrates a cutout close-up view of a portion of the drive shaft of a twin-screw pump assembly without the threaded screw, where clearance adjustment may be performed in accordance with at least some embodiments as described herein.

FIG. 6 illustrates a close-up view of a portion of the drive shaft of a twin-screw pump assembly without the threaded screw, where clearance adjustment may be performed in accordance with at least some embodiments as described herein.

Diagram 600 includes the drive shaft 608 and the driven shaft 618 along with corresponding timing gears (e.g., timing gear 616 for the drive shaft). Threaded screws are not shown. the shape fit provided by the outer surface of the bushing 604 for torque transmission can be seen. Clamping nut 607, as discussed above, is used to provide pretension to the bushing 604.

Figure 7:
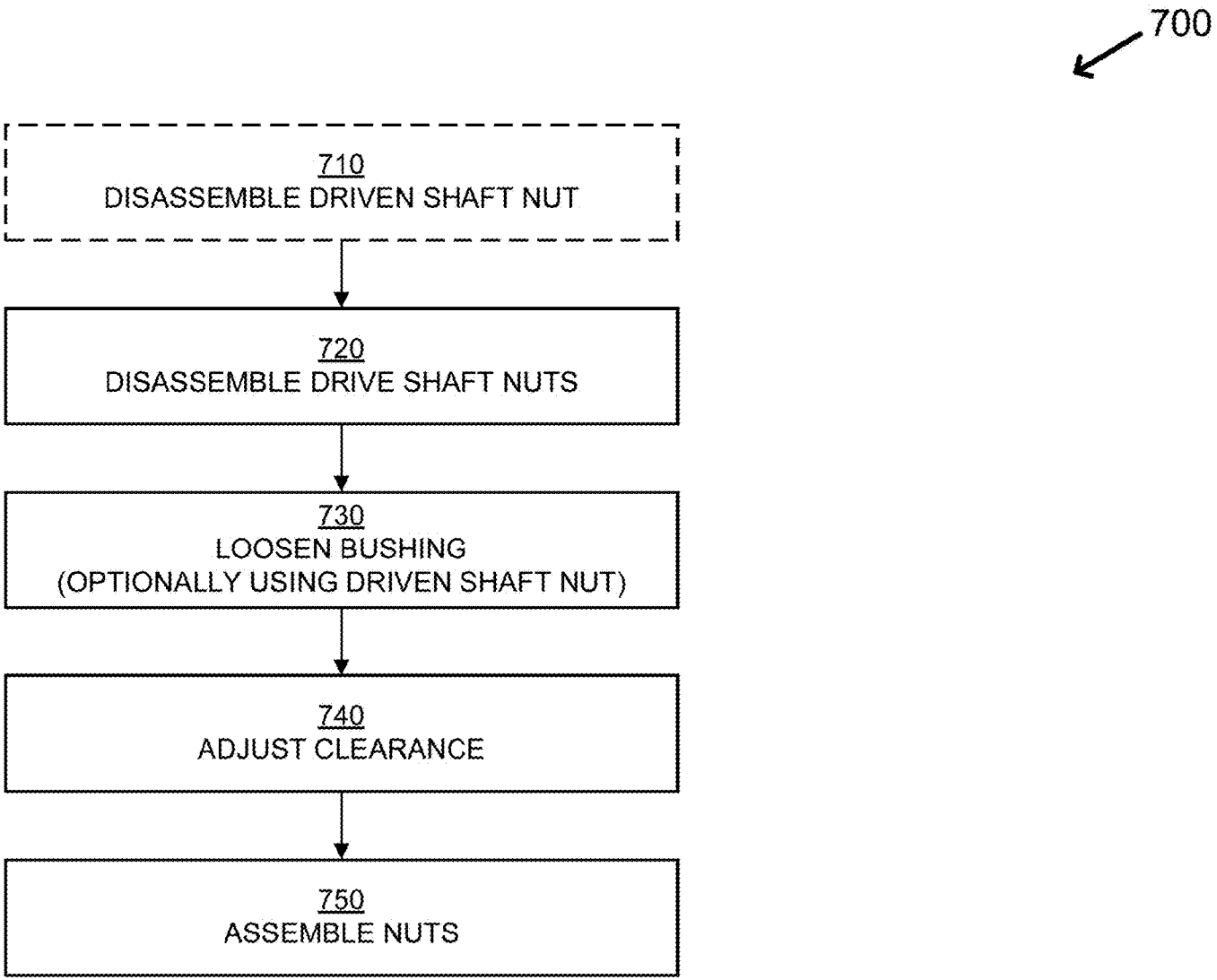
FIG. 7 illustrates an example clearance adjustment method for a twin-screw pump assembly in accordance with at least some embodiments as described herein.

FIG. 7 illustrates an example clearance adjustment method for a twin-screw pump assembly in accordance with at least some embodiments as described herein.

Example methods may include one or more operations, functions, or actions as illustrated by one or more of blocks 710, 720, 730, 740, and 750. Such operations, functions, or actions in FIG. 7 and in the other figures, in some embodiments, may be combined, eliminated, modified, and/or supplemented with other operations, functions or actions, and need not necessarily be performed in the exact sequence as shown.

An example clearance adjustment process may begin with optional block 710, "DISASSEMBLE DRIVEN SHAFT NUT", where the clamping nut securing the threaded screw on the driven shaft may be removed to be used as removal tool for the drive shaft bushing. As described previously, an inside surface of the driven shaft clamping nut may be designed to fit a top portion of the outside surface of the drive shaft bushing such that the driven shaft clamping nut may be used to remove or loosen the drive shaft bushing.

Optional block 710 may be followed by block 720, "DISASSEMBLE DRIVE SHAFT NUTS", where both clamping nuts of the drive shaft may be removed. At first the clamping nut of the drive shaft which secures the threaded screw and at second the clamping nut which pretensions the bushing may be removed.

Block 720 may be followed by block 730, "LOOSEN BUSHING", where the bushing enveloping a conically shaped portion of the drive shaft may be loosened to be re-positioned inside the pump assembly. In some optional examples, the driven shaft clamping nut may be used as removal/loosening tool for the drive shaft bushing. As the adjustment occurs on the flow side of the pump assembly, no lubricant may need to be removed.

Block 730 may be followed by block 740, "ADJUST CLEARANCE", where the bushing may be re-positioned inside the pump assembly. The bushing may be pushed back over the conically shaped portion of the drive shaft upon completion of the adjustment.

Block 740 may be followed by block 750, "ASSEMBLE NUTS", where both clamping nuts of the drive shaft may be re-assembled, where one clamping nut is used to secure and pretension bushing and the other one to secure the axial position of the threaded screw. In some optional examples, the driven shaft clamping nut may be used as removal/loosening tool for the bushing. In such examples, the driven shaft clamping nut may be re-assembled following the re-assembly of the drive shaft clamping nuts.

The operations included in process 700 are for illustration purposes. Clearance adjustment for a twin-screw pump assembly may be implemented by similar processes with fewer or additional operations, as well as in different order of operations using the principles described herein.

The benefits of the presently disclosed a twin-screw pump assemblies and methods of clearance adjustment are numerous. For example, pump assemblies may be adjusted on site with minimal tools and without specialized training or skills. Furthermore, down time during clearance adjustment may be reduced because of the minimal number of parts to be removed and no need for drainage or refilling of lubricant. By simplifying the clearance adjustment process, pump assemblies may be adjusted more frequently, providing a safer environment in hygienic applications (e.g., food & beverage, cosmetics, medical, etc. industries).

The present disclosure is not to be limited in terms of the particular embodiments described in this application, which are intended as illustrations of various aspects. Many modifications and variations can be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled. The terminology used herein is for the purpose of describing particular embodiments only and is not intended to be limiting.

The herein described subject matter sometimes illustrates different components contained within, or connected with, different other components. Such depicted architectures are merely examples, and in fact, many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermediate components. Likewise, any two components so associated may also be viewed as being "operably connected", or "operably coupled", to each other to achieve the desired functionality, and any two components capable of being so associated may also be viewed as being "operably couplable", to each other to achieve the desired functionality. Specific examples of operably couplable include but are not limited to physically connectable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

In general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

For any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments are possible. The various aspects and embodiments disclosed herein are for purposes of illustration and are not intended to be limiting, with the true scope and spirit being indicated by the following claims.

What is claimed is:

1. A method for clearance adjustment of a pump assembly, the method comprising:

removing a first clamping nut that secures rotatably an axial position of a first threaded screw to a drive shaft of the pump assembly, wherein the drive shaft is configured to receive a rotational force outside the pump assembly, the drive shaft comprises a first portion inside a gear chamber defined by the housing and a second portion inside a flow chamber defined by a housing, and at least part of the second portion of the drive shaft is conically shaped;

removing a second clamping nut that provides pretension to a bushing that envelopes the conically shaped part of the second portion of the drive shaft;

loosening the bushing; and adjusting an angularity between the bushing and the drive shaft to enhance clearances between a first plurality of thread flanks of the first threaded screw and a second plurality of thread flanks of a second threaded screw coupled to a driven shaft, wherein the driven shaft comprises a first portion inside the gear chamber and a second portion inside the flow chamber, the first portion of the driven shaft is mechanically coupled to the first portion of the drive shaft through one or more timing gears and configured to receive a rotational force from the drive shaft, and the second portion of the driven shaft is coupled to the second plurality of thread flanks of the second threaded screw intermeshed with the first plurality of thread flanks of the first threaded screw.

2. The method of claim 1, further comprising:

re-assembling the second clamping nut to secure rotatably the bushing and the drive shaft with the adjusted angularity.

3. The method of claim 2, further comprising:

prior to removing the first and second clamping nuts, removing a third clamping nut that secures rotatably an axial position of the second threaded screw to the driven shaft.

4. The method of claim 3, further comprising:

subsequent to re-assembling the second clamping nut, re-assembling the first clamping nut and the third clamping nut.

5. A pump assembly comprising:

a housing comprising:

a first housing wall portion that defines an inlet port, an outlet port, and a flow chamber formed therein, wherein the flow chamber is configured to receive a fluid through the inlet port; and a second housing wall portion that defines a gear chamber formed therein, wherein the flow chamber and the gear chamber are fluidically isolated;

a drive shaft configured to receive a rotational force outside the pump assembly, the drive shaft comprising a first portion inside the gear chamber and a second portion inside the flow chamber, wherein at least part of the second portion of the drive shaft is conically shaped;

a first threaded screw comprising a first plurality of thread flanks and coupled to the second portion of the drive shaft;

a first clamping nut configured to secure rotatably an axial position of the first threaded screw to the drive shaft;

a bushing configured to envelope the conically shaped part of the second portion of the drive shaft;

a second clamping nut configured to provide pretension to the bushing, wherein a clearance adjustment is performed by removal of the first and second clamping nuts, loosening of the bushing, and adjustment of an angularity between the bushing and the drive shaft; and a driven shaft comprising a first portion inside the gear chamber and a second portion inside the flow chamber, wherein the first portion of the driven shaft is configured to receive a rotational force inside the gear chamber from the drive shaft, and the second portion of the driven shaft is coupled to a second threaded screw comprising a second plurality of thread flanks intermeshed with the first plurality of thread flanks of the second portion of the drive shaft.

6. The pump assembly of claim 5, further comprising:

a third clamping nut to secure rotatably an axial position of the second threaded screw to the driven shaft.

7. The pump assembly of claim 5, wherein the drive shaft and the first plurality of thread flanks are integrated, and the driven shaft and the second plurality of thread flanks are integrated.

8. The pump assembly of claim 5, wherein the conically shaped part of the second portion of the drive shaft has an inclination angle in a range from about 1 degree to about 10 degrees.

9. The pump assembly of claim 5, wherein the flow chamber and the gear chamber are fluidically isolated.

10. The pump assembly of claim 5, wherein the first housing wall portion defines at least one additional inlet port and/or at least one additional outlet port.

11. The pump assembly of claim 5, wherein the pump assembly is a dual flow pump assembly.

12. The pump assembly of claim 5, wherein the bushing is made from one or more of a metal, a metal alloy, a ceramic, or a plastic.

13. A pump assembly comprising:

a housing comprising:

a first housing wall portion that defines an inlet port, an outlet port, and a flow chamber formed therein, wherein the flow chamber is configured to receive a fluid through the inlet port; and a second housing wall portion that defines a gear chamber formed therein, wherein the flow chamber and the gear chamber are fluidically isolated;

a drive shaft configured to receive a rotational force outside the pump assembly, the drive shaft comprising a first portion inside the gear chamber and a second portion inside the flow chamber;

a first threaded screw comprising a first plurality of thread flanks and coupled to the second portion of the drive shaft;

a driven shaft comprising a first portion inside the gear chamber and a second portion inside the flow chamber, wherein the first portion of the driven shaft is configured to receive a rotational force inside the gear chamber from the drive shaft, the second portion of the driven shaft is coupled to a second threaded screw comprising a second plurality of thread flanks intermeshed with the first plurality of thread flanks of the second portion of the drive shaft, and at least part of the second portion of the driven shaft is conically shaped;

a first clamping nut configured to secure rotatably an axial position of the second threaded screw to the driven shaft;

a bushing configured to envelope the conically shaped part of the second portion of the driven shaft;

a second clamping nut configured to provide pretension to the bushing, wherein a clearance adjustment is performed by removal of the first and second clamping nuts, loosening of the bushing, and adjustment of an angularity between the bushing and the driven shaft.

14. The pump assembly of claim 13, further comprising:

a third clamping nut to secure rotatably an axial position of the first threaded screw to the drive shaft.

15. A method for manufacturing a twin-screw pump assembly, the method comprising:

forming a flow chamber, an inlet port, and an outlet port within a first housing wall portion of a housing to convey a fluid received through the inlet port to the outlet port;

forming a gear chamber within a second housing wall portion of the housing to house one or more timing gears, a first portion of a drive shaft, and a first portion of a driven shaft, wherein the flow chamber and the gear chamber are fluidically isolated;

positioning a drive shaft configured to receive a rotational force outside the pump assembly such that the first portion of the drive shaft is inside the gear chamber and a second portion of the drive shaft is inside the flow chamber;

positioning a driven shaft, wherein the first portion of the driven shaft is inside the gear chamber and a second portion of the driven shaft is inside the flow chamber, the driven shaft is configured to receive a rotational force from the drive shaft inside the gear chamber, and at least part of the second portion of one of the drive shaft and the driven shaft is conically shaped;

positioning a bushing to envelope the conically shaped part of the second portion of one of the drive shaft and the driven shaft;

providing pretension to the bushing through a first clamping nut;

securing an axial position of a first threaded screw to the drive shaft or an axial position of a second threaded screw to the driven shaft rotatably with a second clamping nut, wherein a clearance adjustment is performed by removal of the first and second clamping nuts, loosening of the bushing, and adjustment of an angularity between the bushing and one of the drive shaft and the driven shaft.

16. The method of claim 15, further comprising:

mechanically coupling the first threaded screw comprising a first plurality of thread flanks to the drive shaft inside the flow chamber; and mechanically coupling the second threaded screw comprising a second plurality of thread flanks to the driven shaft inside the flow chamber, wherein the first plurality of thread flanks are intermeshed with the second plurality of thread flanks.

17. The method of claim 16, further comprising:

mechanically coupling the first portion of the driven shaft to the first portion of the drive shaft through one or more timing gears in the gear chamber.

18. The method of claim 16, further comprising:

forming the first plurality and the second plurality of thread flanks perpendicularly to an axial direction of the drive shaft and the driven shaft.

19. The method of claim 16, further comprising:

forming the first plurality and the second plurality of thread flanks at an angle other than perpendicular to an axial direction of the drive shaft and the driven shaft.

* * * * *